US009716357B2

(12) United States Patent
Zhu

(10) Patent No.: US 9,716,357 B2
(45) Date of Patent: Jul. 25, 2017

(54) ELECTRIC POWER CONNECTING

(71) Applicant: SHANUTEC (SHANGHAI) CO., LTD, Shanghai (CN)

(72) Inventor: Wenting Zhu, Shanghai (CN)

(73) Assignee: SHANUTEC (SHANGHAI) CO., LTD, Shanghai (CN)

( * ) Notice: Subject to any disclaimer, the term of this patent is extended or adjusted under 35 U.S.C. 154(b) by 0 days.

(21) Appl. No.: 15/037,895

(22) PCT Filed: Jan. 27, 2015

(86) PCT No.: PCT/CN2015/071647
§ 371 (c)(1),
(2) Date: May 19, 2016

(87) PCT Pub. No.: WO2015/165291
PCT Pub. Date: Nov. 5, 2015

(65) Prior Publication Data

US 2016/0294132 A1 Oct. 6, 2016

(30) Foreign Application Priority Data

Apr. 27, 2014 (CN) ..... 2014 1 0170743

(51) Int. Cl.
*H01R 25/00* (2006.01)
*H01R 25/14* (2006.01)
*H01R 24/00* (2011.01)

(52) U.S. Cl.
CPC ..... *H01R 25/14* (2013.01); *H01R 24/00* (2013.01)

(58) Field of Classification Search
CPC ..... H01R 24/00; H01R 25/00; H01R 25/14; H01R 25/16; H01R 25/162; H01R 9/2691; H01R 25/142
(Continued)

(56) References Cited

U.S. PATENT DOCUMENTS 6,105,741 A * 8/2000 Ross ..... B60L 5/36 191/23 A
6,296,498 B1 * 10/2001 Ross ..... H01R 25/145 439/115
(Continued)

FOREIGN PATENT DOCUMENTS

CN 87214047 U 8/1988
CN 103956620 A 7/2014
(Continued)

OTHER PUBLICATIONS

The World Intellectual Property Organization (WIPO) International Search Report for PCT/CN2015/071647 May 6, 2015.

*Primary Examiner* — Chandrika Prasad
(74) *Attorney, Agent, or Firm* — Anova Law Group, PLLC

(57) ABSTRACT

A smart home electric power connecting system comprises an electric power connecting guide rail and a socket board module. A slot is formed on the top surface of the electric power connecting guide rail, three conductive copper wires are arranged in the slot, and the three conductive copper wires are connected with a live wire, a null wire and a ground wire of a power source respectively. The socket board module can be inserted in the slot of the electric power connecting guide rail. The electric power connecting guide rail is arranged at the position of a skirting line, a power source bus system is extended to all rooms, the socket board module is capable of being inserted at any place provides available jacks for plugs of electric devices, and an available power source is provided for household appliances nearby.

10 Claims, 2 Drawing Sheets

(58) Field of Classification Search
USPC ..... 439/110, 111, 112
See application file for complete search history.

(56) References Cited

U.S. PATENT DOCUMENTS

| | | | | |
|---|---|---|---|---|
| 6,517,363 | B2 * | 2/2003 | Ross | H01R 25/145 439/115 |
| 7,094,077 | B1 * | 8/2006 | Chen | H01R 25/142 439/118 |
| 7,374,444 | B1 * | 5/2008 | Bennett | H01R 13/652 439/215 |
| 8,469,726 | B2 * | 6/2013 | Perales Fayos | H01R 25/142 439/110 |
| 9,190,791 | B1 * | 11/2015 | Jaena | H01R 25/162 |

FOREIGN PATENT DOCUMENTS

| | | | |
|---|---|---|---|
| CN | 203839636 | U | 9/2014 |
| CN | 203859355 | U | 10/2014 |
| WO | 2008132593 | A2 | 11/2008 |
| WO | 2009153582 | A1 | 12/2009 |

* cited by examiner

ELECTRIC POWER CONNECTING

CROSS-REFERENCES TO RELATED APPLICATIONS

This application is a national stage application of PCT Patent Application No. PCT/CN2015/071647, filed on Jan. 27, 2015, which claims priority to Chinese Patent Application No. 201410170743.3, filed on Apr. 27, 2014, the content of all of which is incorporated herein by reference.

FIELD OF THE INVENTION

The present invention relates to the field of household electric power connecting system and, more particularly, to a smart home electric power connecting system.

BACKGROUND

In a traditional home wire decorating way, the position of a jack is relatively fixed, and if connecting an electric appliance relatively far away is needed, then a power strip bar will be required.

A smart home is a residential platform, which integrates facilities related to home livings by using integrated wiring technologies, network communication technologies, security protection technologies, automatic controlling technologies, as well as audio and video technologies, before constructing a highly efficient management system for residential facilities and daily home affairs, thus improving the safety, convenience, comfort, and artistry for home livings, while achieving an eco-friendly living environment.

Products on electric power system of a smart home may be considered the most basic products in smart home, as all other smart home systems need to rely on a smart home electric power system to achieve electric power transmissions and distribution managements, which includes home communication systems, home LAN, home security protection systems, home entertainment systems and more. Thus, from the function aspect, it may be considered the basis of a smart home, a transmission channel.

In recent years, following the deepening of a smart home concept, in order to achieve an ultimate goal of automatically controlling and managing home appliances, changing the current home wiring and decorating methods, as well as renovating the wiring technologies and electric power systems in the prior art in a reasonable way, have gradually become an important development direction in the smart home field.

BRIEF SUMMARY OF THE DISCLOSURE

Technical Problems

In a traditional home wires decorating way, the location of an electric jack is relatively fixed, and if connecting an electric appliance relatively far away is needed, then a power strip bar will be required, which makes the home look very untidy, due to messy wires, and security risks may exist. Also, arranging too many outlets in a common place, will make the wiring in the wall too complicated, and, it is difficult to predict the exact positions for placing jacks at the moment of wires decorating.

Technical Solutions

The purpose of the present invention is providing an electric power connecting system for smart home, through renovating the wiring modes in a reasonable way. A bus system is extended to all rooms, and power jacks in room walls may be available as the nearest power sources for home appliances anywhere, especially at any places in the skirting line positions close to the ground or the ceiling line positions close to the roof.

In order to achieve the above mentioned goals, the technical solution of the present invention to solve the technical problems is as follows: a simple electric power connecting guide rail is provided, which is spliced at the skirting line positions, the ceiling line positions, or any positions on the wall, to replace a traditional wiring mode which need to bury wires into walls in advance. Thus, it may simplify the complexity for decorations, and increase the easiness of installations. After coordinating with an electric power socket board module plugging and fitting anywhere of the electric power connecting guide rail, which provides power jacks available for plugs of electric appliances, a nearest power source will be available for home appliances, which makes the use of electric appliances more free. The system is very easy and fast to use, as long as the socket plate module is inserted into the power guide rail from top down.

The technical solution of the present invention to solve the technical problems also includes as follows: a smart home electric power connecting system, comprises an electric power connecting guide rail and a socket board module; on top of the electric power connecting guide rail, there is an opening slot arranged, and three conductive copper wires are disposed in the slot, the conductive copper wires connect to the power cords of live, null and ground respectively; the socket board module may be plugged into the slot in the electric power connecting guide rail.

Preferably, the electric power connecting guide rail is arranged at the skirting line position on the wall, and extending to all rooms in the home.

Preferably, the top of the slot side is designed into an arc shape.

Preferably, the electric power connecting guide rail is composed of a skirting line shell, a dustproof insulating rubber strip, a conductive copper wire and a closure wire; a slot is arranged on top of the skirting line shell, a trunk for conductive copper wires installation is arranged in the slot side against outside, and conductive copper wires are installed inside the trunk; while the dustproof insulating rubber strip is arranged in the inner side of the slot opening. All of them are integrated together and arranged at the skirting line position, before extending into all walls in all rooms through simple splicing.

Further, a dust accumulation groove is arranged on the side of the skirting line shell next to the wall.

Preferably, the socket board module is composed of a front panel, a connection panel, a rear panel, a plug spring combining together with a conductive copper piece, an intelligent IC chip and an outer shell for modules connection; the upper part of the connection panel has a square hole used to mount the plug spring, while the lower part contains a long opening slot for the conductive copper piece insertion; the plug spring and the conductive copper piece are made into a solid using the same material, and inserted into the according opening slot in the connection panel; the positions of the three conductive copper pieces adapt to that of the three conductive copper wires installed in the electric power connecting guide rail; the outer shell for modules connection connects all panels together and forms a cavity in the center.

The outer shell for modules connection has a telescopic structure, which is divided into an upper part and a lower part, while the lower part shell may be retracted into the upper part shell under compression.

Preferably, the electric power connecting rail is installed at the ceiling line positions on the wall, and extends into all rooms in the home. Preferably, the electric power connecting rail is installed at a position of 1.5 meters above the ground, and extends into all rooms in the home.

The skirting line shell is a main component of the electric power connecting rail, whose shape is similar to that of an existing skirting line used in home decorations. It is the basis for assembling the rest components, and it provides support to the socket board module in vertical direction. Also, it has a certain strength, and absolute insulation. The long opening slot in the top is used to allow the socket board module be plugged into the middle slot during working, and the side walls of the slot are designed into an arc shape surface 108, as shown in FIG. 1, in order to facilitate inserting the socket board module into a right position. While the back of the slot side facing to outside has the trunk to install conductive copper wires, and the side of the outer shell next to the wall has a dust accumulation groove and isolates water vapor from the wall, whose lower part has a round hole to place a closure wire.

The dustproof insulation rubber strip is installed in the inner side of the corresponding notch in the skirting line shell, which ensures dust or vapor not being able to enter the inner side of the electric power guide rail. The rubber strip has a certain insulation, heat resistance, compressibility and tear resistance, when a socket board module is plugged into the inner side of the guide rail, part of the dustproof insulation rubber strip near the socket board is compressed and deformed, which attaches to the round walls of the slot side, while other parts of the dustproof insulation rubber strip have no deformations and keep ensuring the guide rail closed.

The power conductive copper wires are placed in the according slots in the outer shell of the skirting line, they are covered with elastic insulation materials, while one end connects with one of the three power cords of live, null and ground, and the other end touches one of the three copper pieces installed in the plugged socket board module, thus achieving power transmissions between these two parts.

The closure wire is installed in the round hole in the lower part of the skirting line shell, which induces another branched power connection circuit, and transmits the electric power into a room further away.

The socket board module is composed of a front panel, a connection panel, a rear panel, a plug spring with a conductive copper piece, an intelligent IC chip and an outer shell for modules connection. They are made into a rectangular solid, and during using, lower pins of the connection panel can be plugged into the electric power conductive guide rail and contact with the conductive copper wires, before achieving electric power connections. Both the front and rear panels are attaching to both sides of the guide rail, which increases the connection reliability.

The front panel provides jacks matching the plugs of appliances, and helps the inserted plugs positioning, when in use, it attaches to the outer face of the guide rail, and improves the strength of the module to a certain extent.

The rear panel is inserted into the dust accumulation groove next to the wall in the guide rail when in use, in order to improve the strength of the module to a certain extent.

Upper part of the connection panel has a square hole for the plug spring installation, making the pins pass through in the middle, and the lower part has an elongated slot installed with conductive copper piece. During using, it plugs into the middle slot in the guide rail, any positions in the guide rail are available.

The plug spring and the conductive copper piece, are made into a solid using a same material, and installed into the according notch in the connection panel. The flat pins of a plug pass through the plug spring, and circuit connections are achieved here. The plug spring has a certain curvature to provide an adequate clamping force, and ensures the connection between the plug pin and the module reliable. Three conductive copper pieces extend down to the positions of the three corresponding conductive copper wires in the rail, and the connections are ensured by a compressing force, while other non-connection parts are covered with insulation materials.

The intelligent IC chip is mounted inside the outer shell for modules connection, at a position between the connection panel and the rear panel. It is a chip for control, it may automatically detect the current variations of the electric power source used, and control the on-off of the circuit connection according to real requirements.

The outer shell for modules connection connects to each panel, and forms a cavity in the center to place components including the plug spring, the intelligent chip and others. It is divided into upper and lower parts, composing a telescopic structure, when the module is plugged into the guide rail, the lower part will retract into the upper part of the shell.

Benefits

The smart home electric power connecting system provided in the present invention may replace a conventional wall pre-buried wiring mode, the complexity of decoration is reduced, and mounting convenience is improved. Together with the socket board module capable of being inserted at any place, available jacks for plugs of electric devices are provided, and an available power source is provided for household appliances nearby. The system is convenient to mount, simple in operation, and attractive and practical to use. It is suitable to be spread to smart home electric power systems in normal families, thus it has a broad development and utilization space.

BRIEF DESCRIPTION OF THE DRAWINGS

The reference numbers and corresponding parts are listed as follows.

Figure 1:
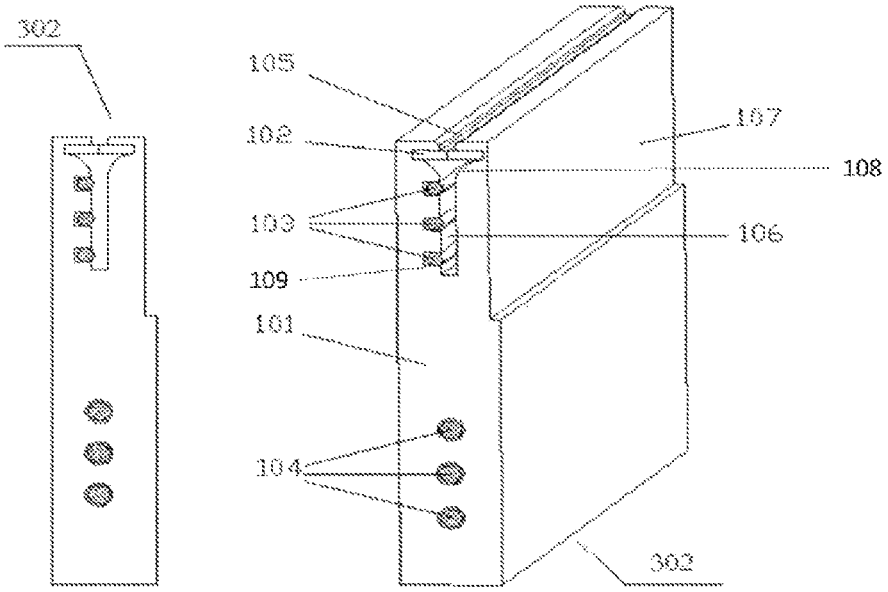
FIG. 1 illustrates a side sectional view and normal axonometric view of the electric power connecting guide rail as provided in the present invention.

101 skirting line shell, 102 dustproof insulating rubber strip, 103 conductive copper wire, 104 closure wire, 105 long opening slot in the top, 106 slot, 107 dust accumulation slot, 201 front panel, 202 connection panel, 203 rear panel, 204 plug spring with conductive copper piece, 205 intelligent IC chip, 206 outer shell for modules connection, 207 front panel jacks, 208 lower part shell, 209 plug insertion path, 301 household electric power distribution box, 302 electric power connecting guide rail, 303 socket board module, 304 plug of appliance.

DETAILED DESCRIPTION OF EMBODIMENTS

A smart home electric power connecting system comprises an electric power connecting guide rail (302) and a socket board module (303). On top of the electric power connecting guide rail (302), there is an opening slot (106) arranged, and a conductive copper wire (103) is disposed in the slot (106), which has a number of three, the conductive copper wires (103) connect to a power cord, which includes three power cords of live, neutral and ground respectively; the socket board module (303) may be plugged into a slot (106) in the electric power connecting guide rail (302).

FIG. 1 illustrates a side sectional view and normal axonometric view of the electric power connecting guide rail as provided in the present invention. As shown in FIG. 1, the electric power connecting guide rail (302) is composed of a skirting line shell (101), a dustproof insulating rubber strip (102), a plurality of conductive copper wires (103) and a closure wire (104). There are a rubber slot, a conductive copper wire slot, a dust accumulation slot (107) and a closure wire hole. The socket board module (303) plugs into the slot (106) through a long opening slot in the top (105), the conductive copper wires (103) connect three power cords (live, neutral and ground) respectively to a plurality of corresponding conductive copper pieces (204) on a plurality of socket board pins, inducing electric power into the socket board module (303). The closure wire (104) is another branch induced from the main power source, and may transmit the power to a further room without any lost.

During installations, part of the electric power connecting guide rail is attached closely to the wall and the ground, following the common position of a skirting line. Three power cords are extended from a household electric power distribution box (301) to the conductive copper wires (103) in the nearest guide rail, and other extended electric wires are hiding in the trunk for closure wire. At the corners of the wall, special socket boards are adopted for connections, then an electric power system covering all corners in the home is achieved.

Figure 2:
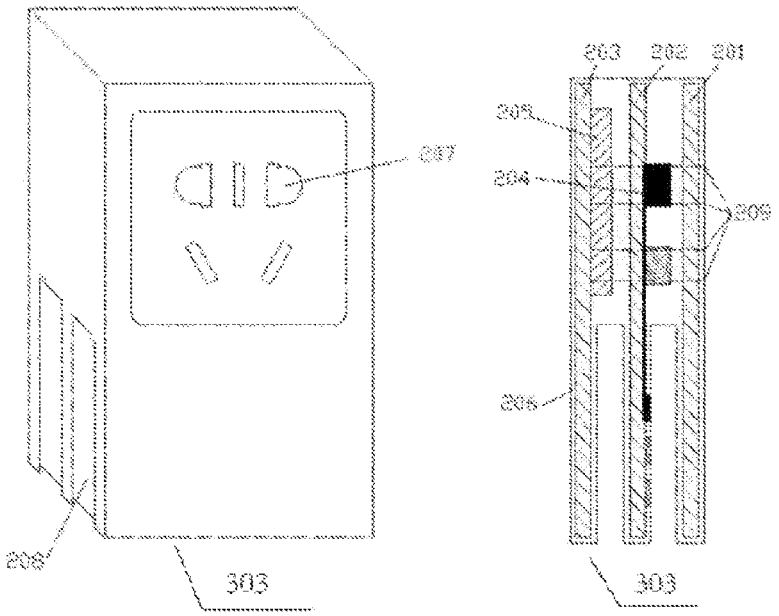
FIG. 2 illustrates a schematic diagram and side sectional view of the socket board module as a whole as provided in the present invention.

As shown in FIG. 2, which is a schematic diagram and side sectional view of the socket board module as a whole, the socket board module (303) is composed of a front panel (201), a connection panel (202), a rear panel (203), a plug spring with conductive copper piece (204), an intelligent IC chip (205) and an outer shell for modules connection (206).

When in use, the socket board module (303) is plugged into the middle slot (106) in the electric power connecting guide rail from top down. Following the plugging process, the lower part shell (208) gradually retracts into the upper part shell, while the fixed pins at the lower part of the connection panel (202) extends into the guide rail gradually. Both the front panel (201) and rear panel (203) attach to either side of the guide rail closely, playing a dual action of both locating and reinforcement.

After fully plugged in, the conductive copper piece (204) connects to the conductive copper wire (103) in the guide rail, and electric power is induced into the front panel jacks (207) in the socket board module, following the paths of conductive copper wire (103) and the plug spring with conductive copper piece (204). Plugs of the appliances are plugging into the front panel jacks (207) following the plug insertion path (209), and pins are clamped tightly by the plug spring (204), then, the appliance reaches the electric power.

Figure 3:
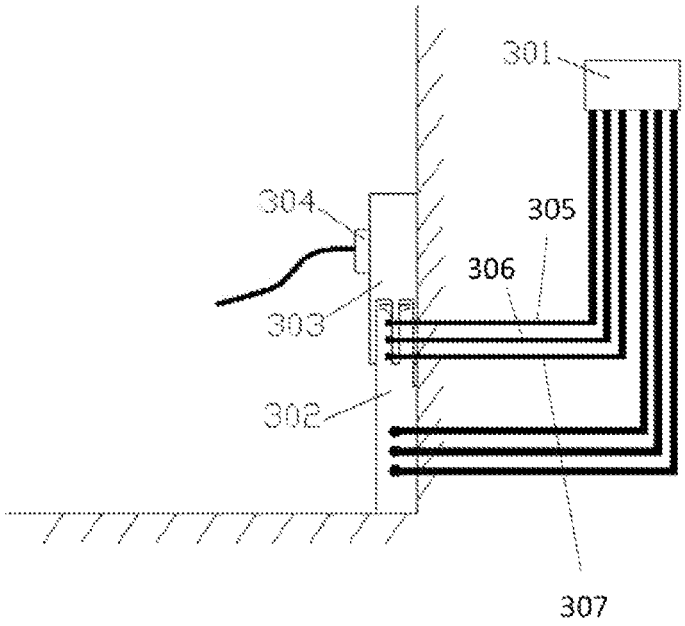
FIG. 3 illustrates a mosaic diagram of the smart home electric system as a whole as provided in the present invention.

As shown in FIG. 3, which illustrates a mosaic diagram of the smart home electric system as a whole, it comprises four parts: household electric power distribution box (301), electric power connecting guide rail (302), socket board module (303), plug of appliance (304).

Power cords are extended from the household electric power distribution box (301), wherein, three of them (the cords of live 305, neutral 306 and ground 307) connect to three conductive copper wires (103) of the electric power connecting guide rail (302), while other power cords connect to the closure wires (104) in the lower part of the guide rail. The socket board module (303) plugs into the middle slot (106) in the guide rail, then the conductive copper pieces (204) connect to the conductive copper wires (103) respectively. Plug of appliance (304) is inserted into the front panel jacks (207) of the socket board module (303), and pins are connected to the plug spring (204). In such a way, connections of the electric power system from the power source to the plug of an appliance are achieved.

The electric power connecting guide rail (302) is attached closely to the wall and the ground, following the common positions of the skirting line, covering all rooms in the home, and at corners of the wall, special socket boards are adopted for connections. The socket board module (303) may be plugged to any positions in the guide rail, ensuring that an appliance may be able to connect to a power source nearby.

The smart home electric power connecting system as provided in the present invention may extend the bus system to all rooms, may provide available power sources nearby for home appliances, through providing power jacks at any places on room walls, especially at the skirting line positions close to the ground and the ceiling line positions close to the roof.

A smart home electric power connecting system comprises an electric power connecting guide rail (302) and a socket board module (303). On top of the electric power connecting guide rail (302), there is an opening slot (106) arranged, and a conductive copper wire (103) is disposed in the slot (106), while the number of the conductive copper wire (103) is three; the three conductive copper wires (103) connect to a power cord of live, neutral and ground respectively; the socket board module (303) may be plugged into a slot (106) in the electric power connecting guide rail (302).

Figure 4:
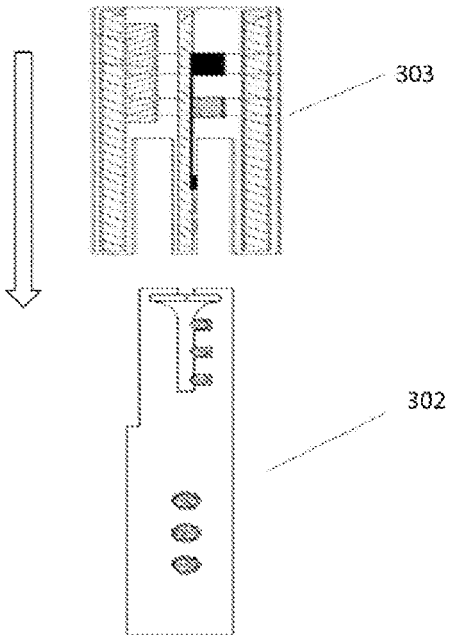
FIG. 4 illustrates a schematic diagram of the connection of the electric power connecting guide rail and the socket board module as provided in the present invention.

FIG. 1 illustrates a side sectional view and normal axonometric view of the electric power connecting guide rail as provided in the present invention. As shown in FIG. 1, the electric power connecting guide rail (302) is composed of a skirting line shell (101), a dustproof insulating rubber strip (102), three conductive copper wires (103) and a plurality of closure wires (104). There are a rubber slot, a conductive copper wire slot, a dust accumulation slot (107) and a closure wire hole. The socket board module (303) plugs into the middle slot (106) through a long opening slot in the top (105), the conductive copper wires (103) connect three power cords (live, neutral and ground) respectively to three according conductive copper pieces (204) on a plurality of socket board pins, inducing electric power into the socket board module (303). The connection of the electric power connecting guide rail 302 and the socket board module 303 is shown in FIG. 4. The closure wire (104) is another branch induced from the main power source, and may transmit the power to a further room without any loss. Similarly, an electric power connecting system for smart home may be installed at the ceiling line position.

During installations, part of the electric power connecting guide rail is attached closely to the wall and the ground, following the common position of a skirting line. Three power cords are extended from a household electric power distribution box (301) to the conductive copper wires (103) in the nearest guide rail, and other extended electric wires are hiding in the trunk for closure wire. At the corners of the wall, special socket boards are adopted for connections, then an electric power system covering all corners in the home is achieved.

As shown in FIG. 2, which is a schematic diagram and side sectional view of the socket board module as a whole, the socket board module (303) is composed of a front panel (201), a connection panel (202), a rear panel (203), a plug spring with conductive copper piece (204), an intelligent IC chip (205) and an outer shell for modules connection (206).

When in use, the socket board module (303) is plugged into the middle slot (106) in the electric power connecting guide rail from top down. Following the plugging process, the lower part shell (208) gradually retracts into the upper part shell, while the fixed pins at the lower part of the connection panel (202) extends into the guide rail gradually. Both the front panel (201) and rear panel (203) attach to either side of the guide rail closely, playing a dual action of both locating and reinforcement.

After fully plugged in, the conductive copper piece (204) connects to the conductive copper wire (103) in the guide rail, and electric power is induced into the front panel jacks (207) in the socket board module, following the paths of conductive copper wire (103) and the plug spring with conductive copper piece (204). Plugs of the appliances are plugging into the front panel jacks (207) following the plug insertion path (209), and pins are clamped tightly by the plug spring (204), then, the appliance reaches the electric power.

As shown in FIG. 3, which illustrates a mosaic diagram of the smart home electric system as a whole, it comprises four parts: household electric power distribution box (301), electric power connecting guide rail (302), socket board module (303), and plug of appliance (304).

Power cords are extended from the household electric power distribution box (301), wherein, three of them (the cords of live, neutral and ground) connect to three conductive copper wires (103) of the electric power connecting guide rail (302), while other power cords connect to the closure wires (104) in the lower part of the guide rail. The socket board module (303) plugs into the middle slot (106) in the guide rail, then the conductive copper pieces (204) connect to the conductive copper wires (103) respectively. Plug of appliance (304) inserts into the front panel jacks (207) of the socket board module (303), and pins are connected to the plug spring (204). In such a way, connections of the electric power system from the power source to the plug of an appliance are achieved.

The electric power connecting guide rail (302) is attached closely to the wall and the ground, following the common positions of the skirting line, covering all rooms in the home, and at corners of the wall, special socket boards are adopted for connections. The socket board module (303) may be plugged to any positions in the guide rail, ensuring that an appliance may be able to connect to a power source nearby.

The electric power connecting system for smart home, as described in the present invention, may also be installed at the ceiling line positions close to the roof, or any positions on the room walls, the structure of the system is the same as that of the system installed in the skirting line positions.

The entire system transforms the power system rationally, and adopts a connection method of inserting a socket board module into an electric power connecting guide rail from top down. It is simple to operate, and easy to use, only one step is required. Thus it owns a pretty good mobility and expandability. It is suitable to be spread to smart home electric systems installed in normal families, thus it owns a broad development and utilization space.

INDUSTRIAL APPLICABILITY

The present invention provides an electric power connecting system for smart home, through renovating the wiring modes in a reasonable way, extending the bus system to all rooms following the skirting line positions, it may provide electric power jacks as the nearest power source available for home appliances at any places in the skirting line positions in the wall.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. A electric power connecting kit, comprising:

an electric power connecting guide rail having an opening slot arranged on top of the electric power connecting guide rail, and three conductive copper wires disposed in the opening slot, the three conductive copper wires being connected to a live power cord, a neutral power cord and a ground cord respectively; and a socket board module having a front panel, a connection panel and a rear panel, the connection panel being plugged into the opening slot in the electric power connecting guide rail, and the front panel and the rear panel being attached to two sides of the electric power connecting guide rail.

2. The electric power connecting kit according to claim 1, wherein, the electric power connecting guide rail is arranged at a skirting line position on a wall of a home, and extends to all rooms in the home.

3. The electric power connecting kit according to claim 1, wherein, a top side of the slot is in an arc shape.

4. The electric power connecting kit according to claim 1, wherein the electric power connecting guide rail further comprises:

a skirting line shell, the opening slot being formed on top of the skirting line shell;

a dustproof insulating rubber strip located on top of the opening slot;

a closure wire located in the skirting line shell under the opening slot; and a trunk for installing the three conductive copper wires.

5. The electric power connecting kit according to claim 4, wherein, a dust accumulation groove is arranged on a side of the skirting line shell next to the wall.

6. The electric power connecting kit according to claim 4, wherein, one end of the closure wire connects to the power source.

7. The electric power connecting kit according to claim 1, wherein the socket board module further comprises:

a plug spring with a conductive copper piece, an upper part of the connection panel having a square hole to mount the plug spring, a lower part of the connection panel being inserted into the opening slot, the plug spring and the conductive copper pieces being made of a same material, the position of the conductive copper pieces being adaptable to the three conductive copper wires installed in the electric power connecting guide rail;

an intelligent IC chip; and an outer shell holding the front panel, the connection panel and the rear panel and forms a cavity in the center.

8. The electric power connecting kit according to claim 7, wherein the outer shell has a telescopic structure, which is divided into an upper part and a lower part, while the lower part shell may be retracted into the upper part under compression.

9. The electric power connecting kit according to claim 1, wherein, the electric power connecting rail is installed at a ceiling line positions on a wall of a home, and extends into all rooms in the home.

10. The electric power connecting kit according to claim 1, wherein, the electric power connecting rail is installed at a position of 1.5 meters above a ground of a home, and extends into all rooms in the home.

* * * * *